US008917034B2

(12) United States Patent
Cozzolino et al.

(10) Patent No.: US 8,917,034 B2
(45) Date of Patent: Dec. 23, 2014

(54) CURRENT OVERSHOOT LIMITING CIRCUIT

(75) Inventors: Carmine Cozzolino, Encinitas, CA (US); Timothy Alan Dhuyvetter, Arnold, CA (US)

(73) Assignee: Fairchild Semiconductor Corporation, San Jose, CA (US)

( * ) Notice: Subject to any disclaimer, the term of this patent is extended or adjusted under 35 U.S.C. 154(b) by 189 days.

(21) Appl. No.: 13/484,962

(22) Filed: May 31, 2012

(65) Prior Publication Data

US 2013/0320881 A1 Dec. 5, 2013

(51) Int. Cl.
*H05B 37/00* (2006.01)

(52) U.S. Cl.
USPC ..... 315/307; 323/282

(58) Field of Classification Search
CPC .... H05B 33/0806; H05B 37/02; H05B 39/04; G05F 5/00; G05F 3/08
USPC ..... 315/307
See application file for complete search history.

(56) References Cited

U.S. PATENT DOCUMENTS

| | | | | |
|---|---|---|---|---|
| 5,844,440 | A | 12/1998 | Lenk et al. | |
| 7,459,891 | B2 | 12/2008 | Al-Shyoukh et al. | |
| 7,728,655 | B2 | 6/2010 | Ng et al. | |
| 7,760,479 | B2 | 7/2010 | Garrett | |
| 2007/0104075 | A1 * | 5/2007 | Shaanan et al. | 369/116 |
| 2009/0224736 | A1 * | 9/2009 | Santo et al. | 323/274 |
| 2010/0264896 | A1 * | 10/2010 | Tonomura | 323/293 |
| 2010/0295476 | A1 | 11/2010 | Franco | |
| 2011/0043052 | A1 * | 2/2011 | Huizenga et al. | 307/112 |
| 2012/0187930 | A1 * | 7/2012 | Williams et al. | 323/273 |
| 2013/0113445 | A1 * | 5/2013 | Cai et al. | 323/265 |
| 2013/0176007 | A1 * | 7/2013 | Devegowda | 323/273 |

FOREIGN PATENT DOCUMENTS

| | | | |
|---|---|---|---|
| CN | 103455073 | A | 12/2013 |
| KR | 1020130135163 | A | 12/2013 |

OTHER PUBLICATIONS

"Chinese Application Serial No. 201320311774.7, Notification to make Rectification mailed Sep. 23, 2013", 2 pgs.

* cited by examiner

*Primary Examiner* — Alexander H Taningco
*Assistant Examiner* — Tanina Bradley
(74) *Attorney, Agent, or Firm* — Schwegman Lundberg & Woessner, P.A.

(57) ABSTRACT

This document discusses, among other things, an apparatus, system, and method to limit a current overshoot in an electronic component using a switched feedback circuit to precondition a gate of a transistor coupled to the electronic component.

24 Claims, 5 Drawing Sheets

CURRENT OVERSHOOT LIMITING CIRCUIT

BACKGROUND

Electronic components, such as light emitting diodes (LEDs), may be damaged by input current overshoot that exceeds compliance levels. Current source drivers can provide essentially constant current for the operation of electronic components. As a result, current source drivers are commonly utilized in the operation of electronic components, such as LEDs.

OVERVIEW

However, like many current sources, current source drivers may produce transients with large voltage or current swings upon a system initially being enabled. The electronic component itself may contribute to such swings by resisting changes in voltage or current. While such current source drivers can stabilize to a constant voltage, the swings upon enablement of the system may produce current overshoot in the electronic component that can damage the electronic component.

This document discusses, among other things, an apparatus, system, and method to limit a current and/or voltage overshoot in an electronic component using a switched feedback circuit to precondition a gate of a transistor coupled to the electronic component.

This section is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

A technique is presented herein that can significantly limit the amount of current overshoot in a current source driver, such as a light emitting diode (LED) flash driver. In an example, a current can be established in a sense field-effect transistor (FET) that stabilizes initial driving amplifier output and input close to the eventual final values of the driving amplifier output and input. When a sufficient driving voltage has been established across an electronic component, such as an LED, to sustain the flash current, the feedback loop can be switched from the sense FET to a sink FET connected to the electronic component.

Figure 1:
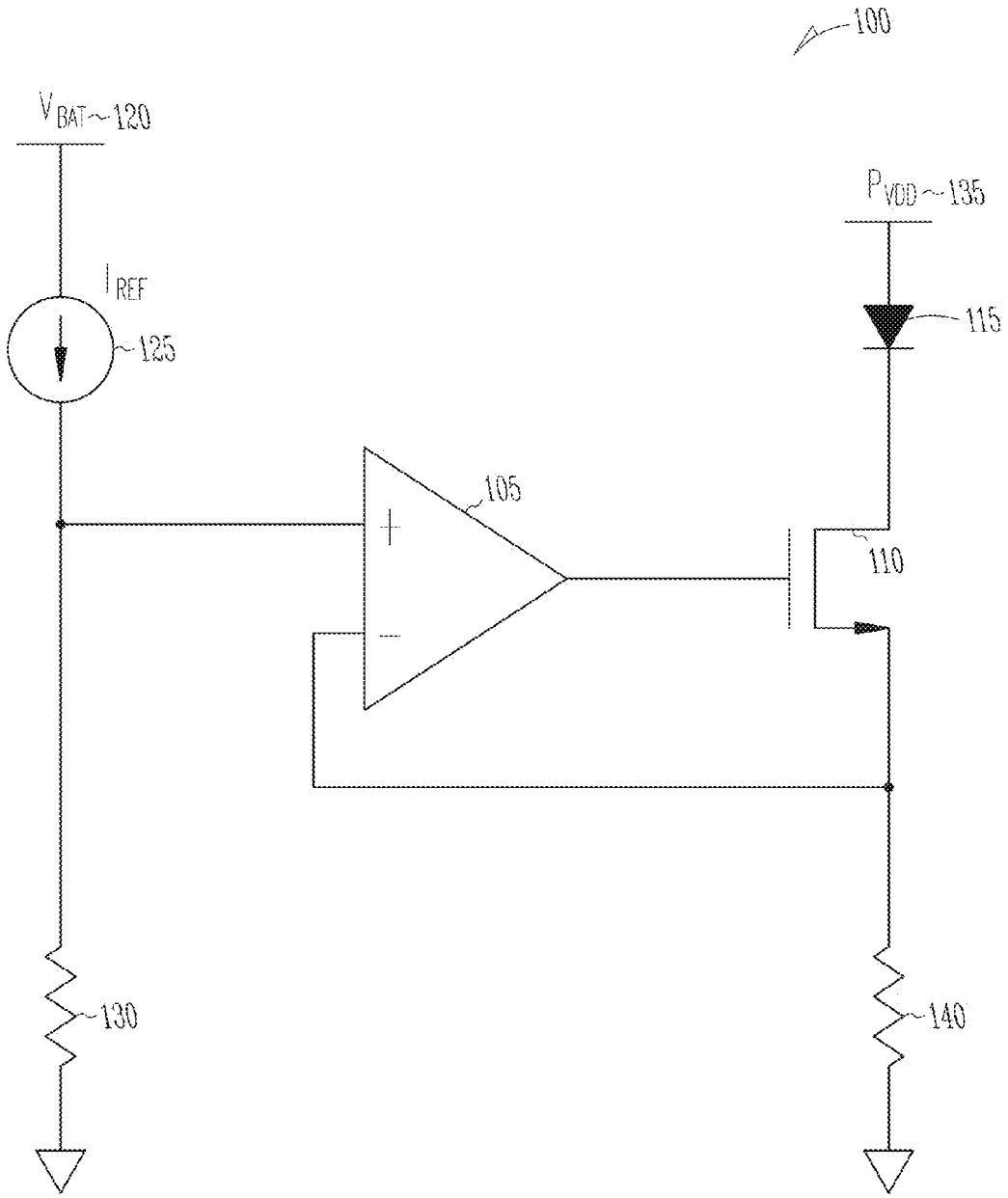
Fig. 1 (PRIOR ART)
FIG. 1 illustrates generally an example current source driver configured to drive an electronic component, such as a light emitting diode (LED).

FIG. 1 illustrates generally an example current source driver 100 including an amplifier 105 and a sink transistor 110 configured to drive an electronic component, such as a light emitting diode (LED) 115. The current source driver 100 can be configured to receive a voltage from a first source, such as a battery ($V_{BAT}$) 120, and a current reference ($I_{REF}$) 125 can be configured to establish and a reference voltage ($V_{REF}$) across a reference resistor 130 to be provided to a non-inverting input of the amplifier 105.

In the example of FIG. 1, the LED 115 can be configured to receive a voltage from a second source, such as a power source ($P_{VDD}$) 135. As the $P_{VDD}$ 135 ramps up (e.g., at startup, etc.), until a threshold voltage is reached, there can be little to no current through the LED 115. Accordingly, the voltage at a source of the sink transistor 110 and the inverting input of the amplifier 105 can be 0V. In response, the amplifier 105 can drive a gate of the sink transistor 110 with a high voltage to try and bring the inverting input of the amplifier 105 equal to that of the non-inverting input.

As $P_{VDD}$ 135 further ramps above a threshold and the LED 115 allows current to flow and a voltage to establish at the inverting input of the amplifier 105, the loop will stabilize, providing current through the LED 115 and a sink resistor 140 to ground. However, prior to stabilization, the current flowing in the LED 115 may experience significant overshoot, in certain examples, above a compliance level of the LED 115 (e.g., as much as 50% above the compliance level, etc.).

Figure 2:
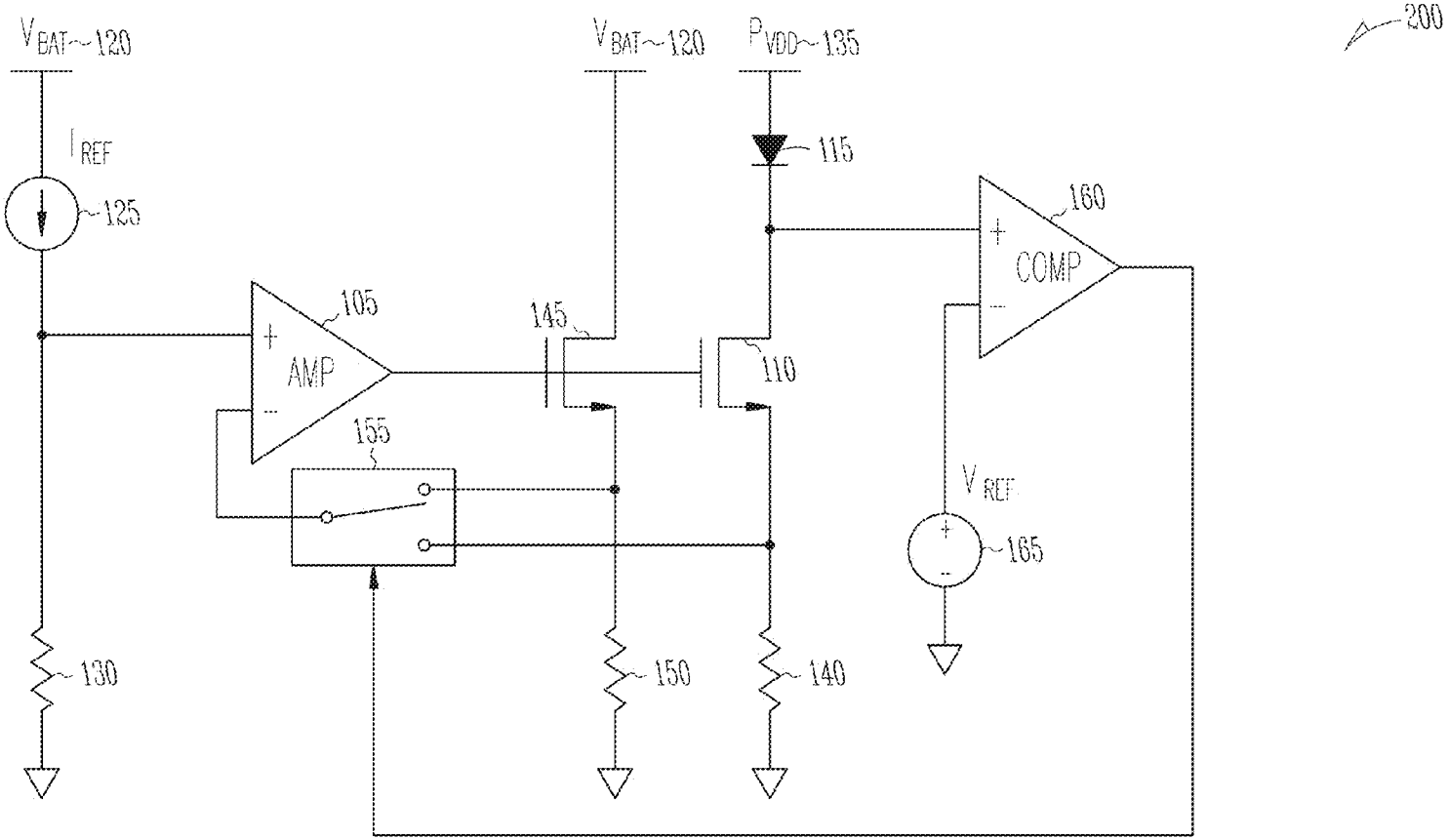
FIG. 2 illustrates generally an example current source driver configured to precondition and drive an electronic component, such as a light emitting diode (LED), with reduced overshoot.

FIG. 2 illustrates generally an example current source driver 200 configured to precondition and drive an electronic component, such as a light emitting diode (LED) 115, with reduced overshoot relative to the current source driver 100. The current source driver 200 can include an amplifier 105, a sense transistor 145, a sink transistor 110, a comparator 160, and a switch 155.

Because the first source (e.g., $V_{BAT}$ 120) may be enabled or otherwise have a voltage ahead of the current source driver 200 as a whole, the voltage at the source of the sense transistor 145 can be achieved very quickly. By contrast, because the second source (e.g., $P_{VDD}$ 135) can include a period of variability upon enablement, and further because the second source can be coupled to the electronic component, the voltage at the source of the sink transistor 110 can take longer to settle at a steady state value.

In an example, when $P_{VDD}$ 135 is below a threshold (e.g., at startup, etc.), the switch 155 can be configured to couple a source of the sense transistor 145 to the inverting input of the amplifier 105. In an example, the size of the sense transistor 145 and a sense resistor 150 can be selected to provide a voltage at the output of the amplifier 105 substantially similar to a final steady-state voltage for supplying the LED 115 and reduce the amount of current overshoot in the LED 115 relative to the current source driver 100.

In an example, as $P_{VDD}$ 135 rises (e.g., above the threshold, etc.), a voltage can be generated at a cathode of the LED 115. A comparator 160 can be configured to compare the voltage at the cathode of the LED 115 to a voltage reference ($V_{REF}$) 165 and to control the switch 155 using the comparison. When the cathode voltage of the LED 115 rises to the voltage level of $V_{REF}$ 165, the switch 155 can connect a source of the sink transistor 110 to the inverting input of the amplifier 105. In this example, the current in the LED 115 can have little to no overshoot, in contrast to the current source driver 100, because the output of the amplifier 105 has been stabilized at a voltage value close to its final steady-state voltage value using the sense transistor 145.

In an example, the sense and sink transistors 145, 110 can include n-channel transistors, such as an n-channel field-effect transistors (FETs), or one or more other type of transistors, including, but not limited to, metal-oxide-semiconductor field-effect transistors (MOSFETs), depletion mode MOSFETs, and n-channel junction gate field-effect transistors (JFETs). In an example, the sense transistor and resistor 145, 150 and the sink transistor and resistor 110, 140 can be respectively sized to produce voltages that are approximately equal at steady-state at the switch 155, yet reduce current draw from the first source (e.g., $V_{BAT}$ 120). In such examples, the size of the sense transistor 145 can be 1/m that of the sink transistor 110, for example, to reduce current draw from the first source, while the size of the sense resistor 150 can be m times that of the sink resistor 140, for example, to achieve approximate similarity in voltage at the sources of the sense and sink transistors 145, 110 at steady-state.

The variable m can be selected to minimize the current through the sense transistor 145. However, reducing the size of the sense transistor 145 may amplify process variations in the making of the sense transistor 145. As a result, while increasing the variable m may produce a smaller current through the sense transistor 145, increasing the variable m may produce variation in the voltage at the source of the sense transistor 145 (e.g., due to process variation). The interest in reduced current and accurate voltage can be balanced given the particular circumstances of various implementations of the current source driver 200. In an example, the variable m can be selected as 1,000. In other examples, one or more other variables can be selected, such as 100 or 10,000.

Figure 3:
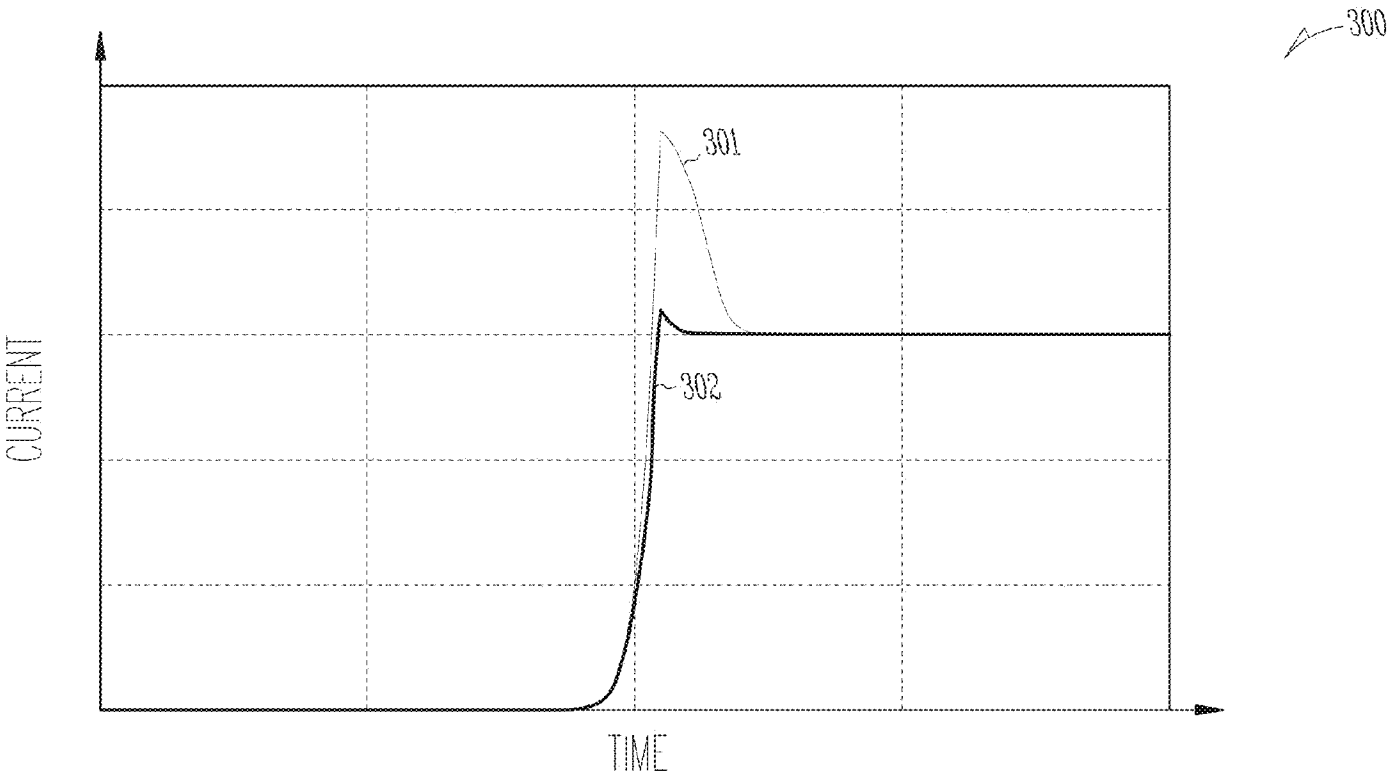
FIG. 3 illustrates generally example current overshoot in an electronic component.

FIG. 3 illustrates generally example current overshoot 300 in an electronic component (e.g., the LED 115) including a first current 301 through the electronic component using the current source driver 100 illustrated in FIG. 1 and a second current 302 through the electronic component using the current source driver 200 illustrated in FIG. 2. The initial overshoot in the first current 301 through the current source driver 100 exceeds the steady-state current by at least 50%. In contrast, the initial overshoot in the second current 302 through the current source driver 200 exceeds the steady-state current by less than 10%.

Figure 4:
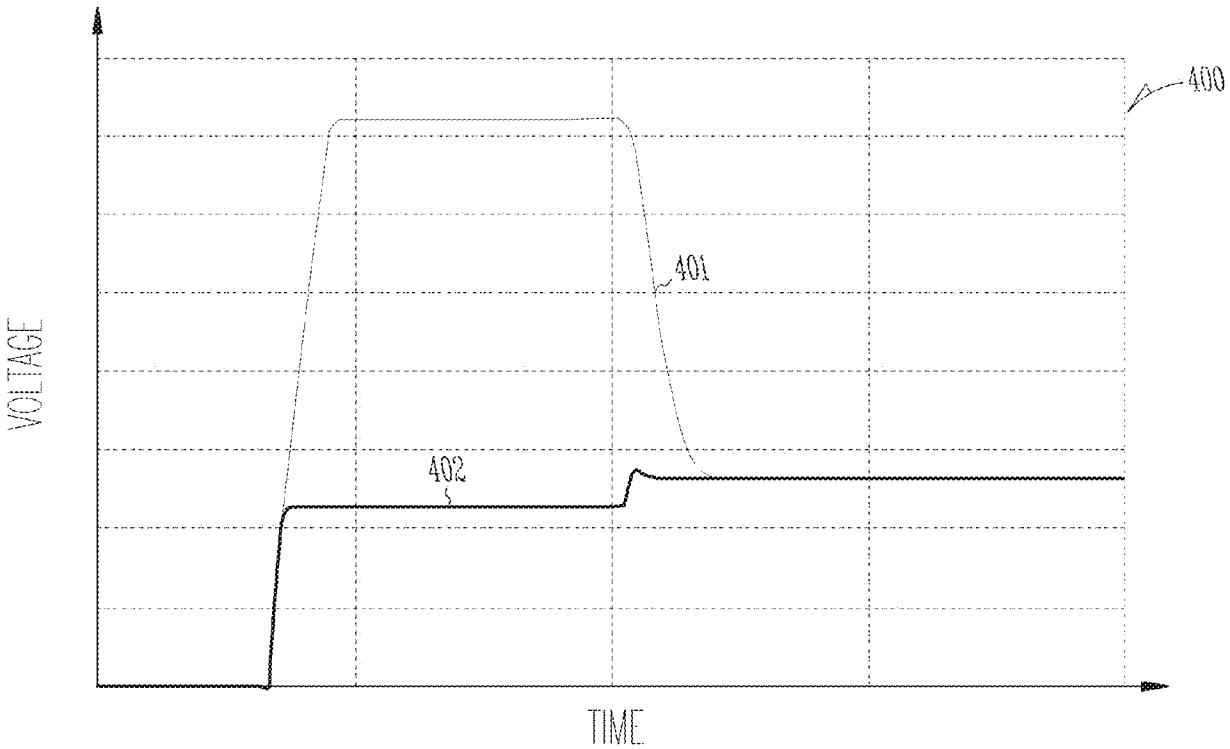
FIG. 4 illustrates generally example output voltage including a first output voltage of the amplifier.

FIG. 4 illustrates generally example output voltage 400 including a first output voltage 401 of the amplifier 105 of the current source driver 100 illustrated in FIG. 1 and a second output voltage 402 of the amplifier 105 of the current source driver 200 illustrated in FIG. 2. Because the voltage at the inverting input of the amplifier 105 can be initially low, the first output voltage 401 can be driven high prior to stabilizing at a steady-state voltage. In contrast to the first output voltage 401, the second output voltage 402 ramps to an initial voltage substantially similar to the steady-state voltage. In the example of FIG. 4, the change between the initial value and the steady-state value of the second output voltage 402 is less 1/10 of that of the change between the initial value and the steady-state value of the first output voltage 401

Figure 5:
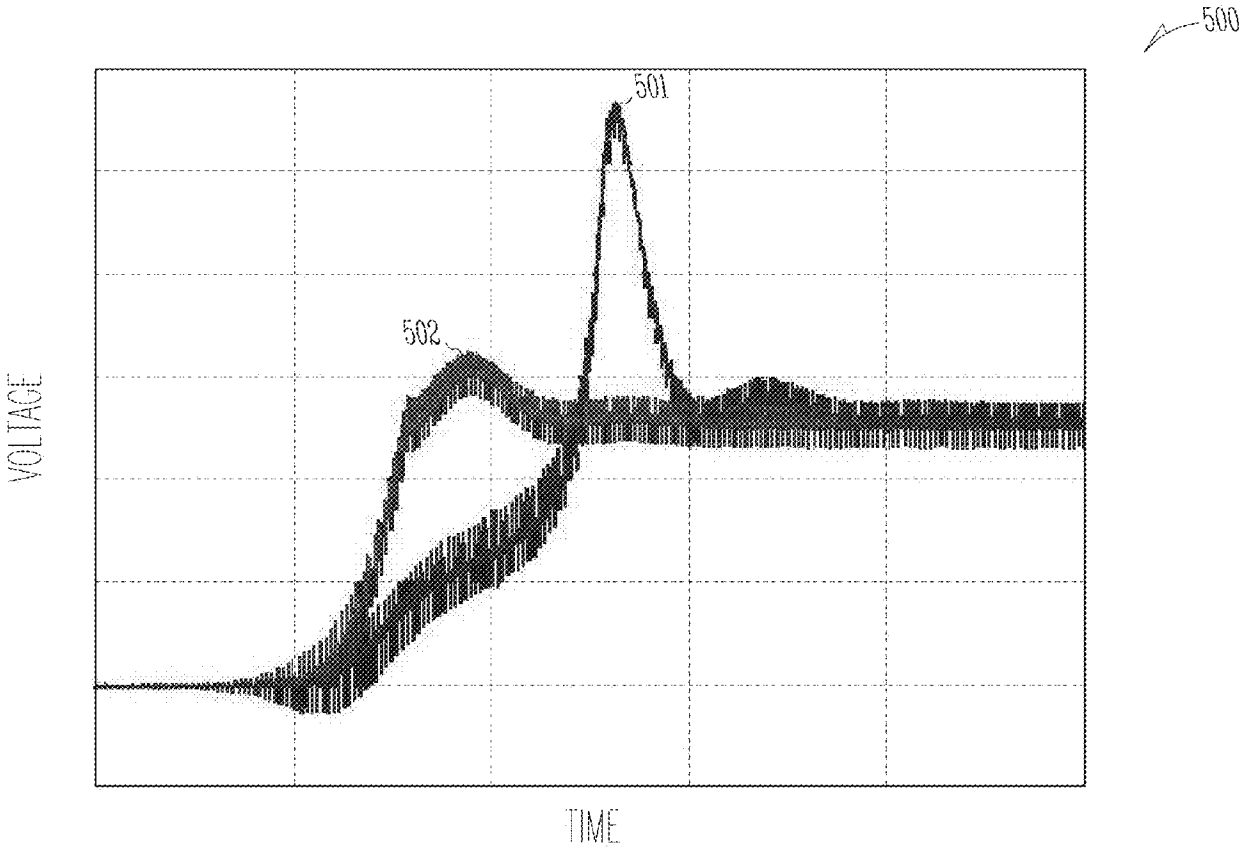
FIG. 5 illustrates generally example cathode voltage of an electronic component.

FIG. 5 illustrates generally example cathode voltage 500 of an electronic component (e.g., the LED 115) including a first cathode voltage 501 of the electronic component in the current source driver 100 illustrated in FIG. 1 and a second cathode voltage 502 of the electronic component in the current source driver 200 illustrated in FIG. 2.

Additional Notes

In Example 1, an apparatus can include an amplifier including an input terminal and an output terminal configured to provide an output voltage, a sense transistor including a sense gate coupled to the output terminal of the amplifier and configured to provide a sense voltage using a first input voltage, a sink transistor including a sink gate coupled to the output terminal of the amplifier, the sink transistor coupled to an electronic component and configured to provide a sink voltage using a second input voltage and a switched feedback circuit configured to selectively precondition the sense and sink gates using the output voltage of the amplifier by selectively coupling the sense voltage and the sink voltage to the input terminal of the amplifier based on the second input voltage, wherein the second input voltage is configured to be selectively enabled, the second input voltage configured to vary from an initial voltage to a final voltage upon the second input voltage being enabled, wherein the switched feedback circuit is configured to selectively couple the sense voltage to the input terminal of the amplifier to limit a current overshoot in the electronic component.

In Example 2, a size of the sink transistor of Example 1 is optionally larger than a size of the sense transistor.

In Example 3, the sense transistor of any one or more of Examples 1-2 is optionally coupled to a first resistor and the sink transistor is coupled to a second resistor, the size of the sink transistor of any one or more of Examples 1-2 is optionally proportional to the size of the sense transistor by a ratio, and the size of the second resistor of any one or more of Examples 1-2 is optionally inversely proportional to the size of the first resistor by the ratio.

In Example 4, the sink voltage of any one or more of Examples 1-3 is optionally based on a voltage drop over the electronic component.

In Example 5, the current overshoot in the electronic component of any one or more of Examples 1-4 is optionally based on the voltage drop over the component exceeding a compliance voltage of the electronic component.

In Example 6, the switched feedback circuit of any one or more of Examples 1-5 optionally includes a comparator configured to generate an output and to be coupled to the sink transistor and the electronic component and a switch coupled to the comparator and the sense and sink transistors, the switch configured to selectively couple at least one of the sense and sink transistor to provide at least a respective one of the sense and sink voltage to the input terminal of the amplifier based, at least in part, on the output of the comparator.

In Example 7, the switch of any one or more of Examples 1-6 is optionally a binary switch configured to selectively couple only one of the sense voltage and the sink transistors to the amplifier input at any time.

In Example 8 the comparator of any one or more of Examples 1-7 is optionally configured to compare a comparison voltage based on the sink voltage against a voltage reference to generate the output.

In Example 9, a voltage source configured to deliver the second input voltage in any one or more of Examples 1-8 is optionally In Example 10, the voltage source of any one or more of Examples 1-9 is optionally configured to increase a magnitude of the second input voltage from the initial voltage to the final voltage In Example 11, the electronic component of any one or more of Examples 1-10 optionally includes a light emitting diode (LED).

In Example 12, the first input voltage of any one or more of Examples 1-11 is optionally generated by a battery.

In Example 13, a method includes providing an output voltage from an output terminal of an amplifier, providing a sense voltage with a sense transistor using a first input voltage, providing a sink voltage with a sink transistor coupled to an electronic component and using a second input voltage, preconditioning, using a switched feedback circuit, a sense gate of the sense transistor and a sink gate of the sink transistor using the output voltage of the amplifier by selectively coupling the sense voltage and the sink voltage to an input terminal of the amplifier based on the second input voltage, selectively enabling the second input voltage, the second input voltage varying from an initial voltage to a final voltage upon the second input voltage being enabled, and selectively coupling, using the switched feedback circuit, the sense voltage to the input terminal of the amplifier to limit a current overshoot in the electronic component.

In Example 14, providing the sense voltage and providing the sink voltage of any one or more of Examples 1-13 are optionally based on a size of the sink transistor being larger than a size of the sense transistor.

In Example 15, providing the sense voltage and providing the sink voltage of any one or more of Examples 1-14 are optionally based on the sense transistor being coupled to a first resistor and the sink transistor being coupled to a second resistor, the size of the sink transistor of any one or more of Examples 1-14 is optionally proportional to the size of the sense transistor by a ratio, and the size of the second resistor of any one or more of Examples 1-14 is optionally inversely proportional to the size of the first resistor by the ratio.

In Example 16, providing the sink voltage of any one or more of Examples 1-15 is optionally based on a voltage drop over the electronic component.

In Example 17, selectively coupling the sense voltage to the input terminal the current overshoot in the electronic component of any one or more of Examples 1-16 is optionally based on the voltage drop over the component exceeding a compliance voltage of the electronic component.

In Example 18, generating an output with a comparator of the switched feedback circuit of any one or more of Examples 1-17 is optionally coupled to the sink transistor and electronic component, and selectively coupling at least one of the sense and sink transistor, with a switch of the switched feedback circuit coupled to the comparator and the sense and sink transistors, of any one or more of Examples 1-17 optionally provides at least a respective one of the sense and sink voltage to the input terminal of the amplifier based, at least in part, on the output of the comparator.

In Example 19, the switch of any one or more of Examples 1-18 is optionally a binary switch, and selectively coupling with the switch of any one or more of Examples 1-18 optionally selectively couples only one of the sense voltage and the sink transistors to the amplifier input at any time.

In Example 20, generating an output with the comparator of any one or more of Examples 1-19 optionally generates a comparison voltage based on the sink voltage against a voltage reference to generate the output.

In Example 21, delivering the second input voltage in of any one or more of Examples 1-20 is optionally with a voltage source.

In Example 22, any one or more of Examples 1-21 optionally increases a magnitude of the second input voltage from the initial voltage to the final voltage In Example 23, the electronic component of any one or more of Examples 1-22 optionally includes a light emitting diode (LED).

In Example 24, the first voltage source of any one or more of Examples 1-23 is optionally generated with a battery.

In Example 25, a system includes an amplifier including an input terminal and an output terminal configured to provide an output voltage, a sense transistor including a sense gate coupled to the output terminal of the amplifier and configured to provide a sense voltage using a first input voltage from a battery, a voltage source configured to be selectively enabled to provide a second input voltage, the second input voltage configured to vary from an initial voltage to a final voltage upon the second input voltage being enabled, a sink transistor including a sink gate coupled to the output terminal of the amplifier, the sink transistor configured to be coupled to a light emitting diode (LED) and configured to provide a sink voltage using the second input voltage, and a switched feedback circuit configured to selectively precondition the sense and sink gates using the output voltage of the amplifier by selectively coupling the sense voltage and the sink voltage to the input terminal of the amplifier based on the second input voltage, and selectively couple the sense voltage to the input terminal of the amplifier to limit a current overshoot in the electronic component.

In Example 26, a size of the sink transistor of any one or more of Examples 1-25 is optionally larger than a size of the sense transistor, the sense transistor of any one or more of Examples 1-25 is optionally coupled to a first resistor and the sink transistor is coupled to a second resistor, the size of the sink transistor of any one or more of Examples 1-25 is optionally proportional to the size of the sense transistor by a ratio, and the size of the second resistor of any one or more of Examples 1-25 is optionally is inversely proportional to the size of the first resistor by the ratio.

In Example 27, a system or apparatus can include, or can optionally be combined with any portion or combination of any portions of any one or more of Examples 1-26 to include, means for performing any one or more of the functions of Examples 1-26, or a machine-readable medium including instructions that, when performed by a machine, cause the machine to perform any one or more of the functions of Examples 1-26.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. An apparatus comprising:

an amplifier including an input terminal and an output terminal configured to provide an output voltage;

a sense transistor including a sense gate coupled to the output terminal of the amplifier and configured to provide a sense voltage using a first input voltage;

a sink transistor including a sink gate coupled to the output terminal of the amplifier, the sink transistor coupled to an electronic component and configured to provide a sink voltage using a second input voltage;

a switched feedback circuit configured to selectively precondition the sense and sink gates using the output voltage of the amplifier by selectively coupling the sense voltage and the sink voltage to the input terminal of the amplifier based on the second input voltage, wherein the switched feedback circuit includes:

a comparator configured to generate an output and to be coupled to the sink transistor and the electronic component; and a switch coupled to the comparator and the sense and sink transistors, the switch configured to selectively couple at least one of the sense and sink transistor to provide at least a respective one of the sense and sink voltage to the input terminal of the amplifier based, at least in part, on the output of the comparator;

wherein the second input voltage is configured to be selectively enabled, the second input voltage configured to vary from an initial voltage to a final voltage upon the second input voltage being enabled; and wherein the switched feedback circuit is configured to selectively couple the sense voltage to the input terminal of the amplifier to limit a current overshoot in the electronic component.

2. The apparatus of claim 1, wherein a size of the sink transistor is larger than a size of the sense transistor.

3. The apparatus of claim 2, wherein the sense transistor is coupled to a first resistor and the sink transistor is coupled to a second resistor;

wherein the size of the sink transistor is proportional to the size of the sense transistor by a ratio;

wherein the size of the second resistor is inversely proportional to the size of the first resistor by the ratio.

4. The apparatus of claim 1, wherein the sink voltage is based on a voltage drop over the electronic component.

5. The apparatus of claim 4, wherein the current overshoot in the electronic component is based on the voltage drop over the component exceeding a compliance voltage of the electronic component.

6. The apparatus of claim 1, wherein the switch is a binary switch configured to selectively couple only one of the sense voltage and the sink transistors to the amplifier input at any time.

7. The apparatus of claim 1, wherein the comparator is configured to compare a comparison voltage based on the sink voltage against a voltage reference to generate the output.

8. The apparatus of claim 1, comprising a voltage source configured to deliver the second input voltage.

9. The apparatus of claim 8, wherein the voltage source is configured to increase a magnitude of the second input voltage from the initial voltage to the final voltage.

10. The apparatus of claim 1, wherein the electronic component includes a light emitting diode (LED).

11. The apparatus of claim 1, wherein the first input voltage is generated by a battery.

12. A method comprising:

providing an output voltage from an output terminal of an amplifier;

providing a sense voltage with a sense transistor using a first input voltage;

providing a sink voltage with a sink transistor coupled to an electronic component and using a second input voltage; and preconditioning, using a switched feedback circuit, a sense gate of the sense transistor and a sink gate of the sink transistor using the output voltage of the amplifier by selectively coupling the sense voltage and the sink voltage to an input terminal of the amplifier based on the second input voltage, the preconditioning including:

generating, with a comparator of the switched feedback circuit, an output and to be coupled to the sink transistor and the electronic component; and selectively coupling, with a switch of the switched feedback circuit the switch coupled to the comparator and the sense and sink transistors, at least one of the sense and sink transistor to provide at least a respective one of the sense and sink voltage to the input terminal of the amplifier based, at least in part, on the output of the comparator;

selectively enabling the second input voltage, the second input voltage varying from an initial voltage to a final voltage upon the second input voltage being enabled; and selectively coupling, using the switched feedback circuit, the sense voltage to the input terminal of the amplifier to limit a current overshoot in the electronic component.

13. The method of claim 12, wherein the providing the sense voltage and providing the sink voltage are based on a size of the sink transistor being larger than a size of the sense transistor.

14. The method of claim 13, wherein providing the sense voltage and providing the sink voltage are based on the sense transistor being coupled to a first resistor and the sink transistor being coupled to a second resistor;

wherein the size of the sink transistor is proportional to the size of the sense transistor by a ratio;

wherein the size of the second resistor is inversely proportional to the size of the first resistor by the ratio.

15. The method of claim 12, wherein providing the sink voltage is based on a voltage drop over the electronic component.

16. The method of claim 15, wherein selectively coupling the sense voltage to the input terminal to limit the current overshoot in the electronic component is based on the voltage drop over the component exceeding a compliance voltage of the electronic component.

17. The method of claim 12, wherein the switch is a binary switch; and wherein selectively coupling with the switch selectively couples only one of the sense voltage and the sink transistors to the amplifier input at any time.

18. The method of claim 12, wherein generating an output with the comparator generates a comparison voltage based on the sink voltage against a voltage reference to generate the output.

19. The method of claim 12, comprising delivering the second input voltage with a voltage source.

20. The method of claim 19, comprising increasing a magnitude of the second input voltage from the initial voltage to the final voltage.

21. The method of claim 12, wherein the electronic component includes a light emitting diode (LED).

22. The method of claim 12, comprising generating the first voltage source with a battery.

23. A system comprising:

an amplifier including an input terminal and an output terminal configured to provide an output voltage;

a sense transistor including a sense gate coupled to the output terminal of the amplifier and configured to provide a sense voltage using a first input voltage from a battery;

a voltage source configured to be selectively enabled to provide a second input voltage, the second input voltage configured to vary from an initial voltage to a final voltage upon the second input voltage being enabled;

a sink transistor including a sink gate coupled to the output terminal of the amplifier, the sink transistor configured to be coupled to a light emitting diode (LED) and configured to provide a sink voltage using the second input voltage; and a switched feedback circuit configured to:

selectively precondition the sense and sink gates using the output voltage of the amplifier by selectively coupling the sense voltage and the sink voltage to the input terminal of the amplifier based on the second input voltage; and selectively couple the sense voltage to the input terminal of the amplifier to limit a current overshoot in the electronic component, wherein the switched feedback circuit includes:

a comparator configured to generate an output and to be coupled to the sink transistor and the electronic component; and a switch coupled to the comparator and the sense and sink transistors, the switch configured to selectively couple at least one of the sense and sink transistor to provide at least a respective one of the sense and sink voltage to the input terminal of the amplifier based, at least in part, on the output of the comparator.

24. The system of claim 23 wherein a size of the sink transistor is larger than a size of the sense transistor;

wherein the sense transistor is coupled to a first resistor and the sink transistor is coupled to a second resistor;

wherein the size of the sink transistor is proportional to the size of the sense transistor by a ratio;

wherein the size of the second resistor is inversely proportional to the size of the first resistor by the ratio.

* * * * *